US006061962A

United States Patent [19]

Sosa

[11] Patent Number: 6,061,962

[45] Date of Patent: May 16, 2000

[54] OPERATING ASSEMBLY FOR JALOUSIE WINDOW WITH NEGATIVE PRESSURE LOCK

[75] Inventor: Jesus M. Sosa, Rio Piedras, Puerto Rico

[73] Assignee: Vent-Alarm Corporation, Gurabo, Puerto Rico

[21] Appl. No.: 09/086,106

[22] Filed: May 29, 1998

Related U.S. Application Data

[63] Continuation-in-part of application No. 08/951,568, Oct. 16, 1997, Pat. No. 5,907,926.

[51] Int. Cl.[7] ..... E05D 15/28

[52] U.S. Cl. ..... 49/249; 49/394

[58] Field of Search ..... 49/246, 247, 248, 49/249, 250, 261, 339, 345, 394

[56] References Cited

U.S. PATENT DOCUMENTS

| | | | |
|---|---|---|---|
| 2,761,674 | 9/1956 | Walberg et al. | 49/251 X |
| 3,954,023 | 5/1976 | Perez-Aguilar . | |
| 3,994,095 | 11/1976 | Hare . | |
| 4,449,121 | 5/1984 | Sosa . | |
| 4,926,599 | 5/1990 | Scholz . | |
| 5,907,926 | 6/1999 | Sosa | 49/249 |

*Primary Examiner*—Jerry Redman

*Attorney, Agent, or Firm*—Duane, Morris & Heckscher, LLP

[57] ABSTRACT

An operator and secondary lock for a jalousie window includes a linkage with two toggle joints and a locking lever having a camming edge. The toggle joints assist in locking the window in its fully opened or fully closed position. The toggle joints are actuated by a lever mounted to the window frame so as to provide a mechanical advantage for operation of the jalousie window. The secondary lock engages a lower connecting bar when the windows are in their closed position to prevent opening of the windows by negative air pressure or by prying. The mechanical advantage afforded by the operator allows relatively heavy jalousie window louvers and associated moving components to be actuated over a tolerable range of actuating forces. In addition, brakes permit the louvers to be held frictionally at any fixed orientations between the fully opened and fully closed positions of the window.

20 Claims, 10 Drawing Sheets

OPERATING ASSEMBLY FOR JALOUSIE WINDOW WITH NEGATIVE PRESSURE LOCK

CROSS REFERENCE TO RELATED APPLICATION

This is a continuation-in-part of patent application Ser. No. 08/951,568, filed Oct. 16, 1997, now U.S. Pat. No. 5,907,926.

BACKGROUND OF THE INVENTION

1. Field of the Invention

This invention relates to operating assemblies or operators for jalousie windows, and more particularly, to a lever-based operator and a secondary locking mechanism.

2. Prior Art

Jalousie windows generally include louvers extending across and pivoted in a rectangular window frame. The louvers are often rectangular and are generally mounted in the window frame at vertically spaced locations, often in such a way that, when the louvers are fully closed, opposing horizontal edges of adjacent louvers either abut each other or preferably overlap slightly such that upper louvers lap over lower louvers on the outside of the window. The louvers are parallel and substantially horizontal when fully open, thereby opening vertical spaces between the horizontal louvers for airflow, line-of-sight, etc.

The louvers are mounted on parallel horizontal pivot axes and are mechanically linked to open or close as a unit. To open the louvers, a user actuates an operating mechanism to rotate the louvers outwardly around a horizontal axis at or near the upper horizontal edges of each louver. In this way, the jalousie window provides light and ventilation by allowing air to pass between the opened louvers.

One mechanism for operating a jalousie window generally includes a rotatable crank with associated pinions and gears. Rotation of the crank is transformed into translational displacement of a window bar operatively connected to the louvers, that is, translational displacement of the window bar causes the louvers to open or shut. The window bar can be an integral connecting bar pivotally attached at regular intervals to the louvers, in each case at a space from their pivot axes. Alternatively, a connecting linkage having plural links coupling adjacent louvers to the operating mechanism can operate all the louvers as a unit.

Jalousie windows are applied in a variety of settings having different needs for ventilation, light transmission, appearance, security and the like. Applications range from heavy industrial to residential, and may concern windows or doors of buildings, porches and sunrooms, mobile homes and other vehicles. The louvers often comprise glass, plexiglass or other transparent or translucent material, and in the commercial context may comprise metal or another opaque material. Jalousie structures also serve as vents for manufacturing plants and other industrial facilities and structures as well as fire-damping controllable closures in HVAC ducts, which also may be considered windows in accordance with the invention. Metal-louver jalousie windows are also useful when security is an issue.

New building codes require that windows resist "wind-load" in both positive and negative conditions (inward and outward). The structure of jalousie windows inherently provides significant locking of the louvers against positive (inward) pressure, since the louvers rest directly against one another when closed. Positive loads tend to cause the louvers to close tighter. However, against negative (outward) pressure, the structure is inherently weak. When negative (outward) pressure is applied, prior art louvers often tend to open outwardly, resisted if at all only by the frictional resistance of the operating mechanism. It is not desirable that the operating mechanism have substantial frictional resistance. Therefore, the opening of the louvers may be a significant problem, especially during heavy storm conditions or when a mechanical force is applied by a burglar or the like.

The material, size and thickness of the louvers are selected to suit the security and other demands of the particular application. The number of louvers and their respective dimensions vary depending on the size of the jalousie window, as well as the particular industrial, commercial, or residential application. A jalousie window of a given size may have relatively more louvers that are narrow or fewer louvers that are wide. Wide louvers pivoted at their top edges can present a substantial weight when open, producing a force resisted by the friction of the operating mechanism. For wide louvers, the pivot axes can be spaced downwardly from the top edges to more nearly balance the louvers and thereby reduce the applied force. However, this is less desirable than placing the pivot near the top edge so that the louvers open outwardly.

It is desirable for jalousie windows—of whatever configuration—to be straightforward and relatively easy for the user to operate, while at the same time satisfying ventilation, security, access, and other requirements associated with windows. Jalousie windows typically are opened and closed by winding a crank mechanism comprising worm and pinion gears arranged to translate the window bar coupled to the louvers. The mechanical advantage of the gearing enables the user to turn the crank readily to open, close or otherwise adjust the jalousie window to maintain a desired louver angle. As a trade-off for mechanical advantage, multiple turns of the crank may be needed to move the louvers between the fully closed and fully open positions.

The louvers should remain at the desired angle where they are set, not tend to sag toward the closed position due to gravity or to open further under wind pressure. A worm and pinion mechanism or the like, having a substantial or moderate gear reduction ratio, can provide the necessary frictional resistance to hold the louvers in place. However, friction makes the mechanism more difficult to operate, and may dictate a need for even greater mechanical advantage.

Some of the same considerations apply to jalousie structures used, for example, as automatically operable ventilation dampers. Ventilation dampers are normally maintained in either the fully opened or fully closed position, unlike windows wherein the louvers are adjusted to remain at any desired angle. Nevertheless, a certain force and stroke length is needed to translate the connecting bar and the louvers between the fully open and closed positions. Mechanical advantage, stroke length and power constraints affect the nature of the operating mechanism and the source of motive power (for example, a gear motor, solenoid, etc.) as well as its cost.

In more general terms, the need to make a jalousie structure relatively easy to operate acts as a design constraint potentially limiting not only the size, shape, and number of louvers, but also dictating the configuration, gearing ratios, relative sizes, and other aspects of the other moving components of the window. These constraints are especially important for large or heavy jalousie windows such as security windows having cantilevered louvers made out of heavy material such as steel, or whenever security or other design requirements necessitate a robust construction with heavy louvers and sturdy moving parts. In other words, if the louvers and moving components of a given jalousie window design need to be relatively heavy, it can be difficult to design a correspondingly robust operating mechanism which meets the user's need to operate the window without excessive exertion, to cause the louvers to maintain a desired louver angle, and to do so at reasonable cost.

Accordingly, there is a need for a durable jalousie window and operating mechanism that is easy to operate, delivers sufficient actuating force for a wide variety of jalousie window designs, and maintains a selected louver angle without introducing excessive frictional resistance. Additionally, without contributing to frictional resistance, there is a need for a design that permits a jalousie window to be fixed, especially in its fully closed position, to avoid unwanted opening of the window during negative (outward) air pressure conditions or vibration and flapping of the louvers during gusts. There is a further need for such operating mechanism and secondary lock to be relatively straightforward and inexpensive to manufacture.

SUMMARY OF THE INVENTION

It is an object of this invention to overcome shortcomings of conventional jalousie window structures, operating mechanisms, and locking mechanisms by providing a lever-operated jalousie window with a toggle linkage, associated jalousie window operator, and secondary lock. The mechanism includes a linkage with an actuator end and a window end opposite the actuator end. A toggle joint is included as part of the linkage. The linkage includes an actuating lever secured through the linkage to a pivotable louver panel, and preferably to a connecting bar rotatably linking a plurality of hinged louver panels at points spaced eccentrically from their hinging axes. The actuator rotates through a predetermined arc around a fixed axis, causing a secondary lever to rotate around a second fixed axis spaced from the first. The secondary lever translates a connecting bar coupled eccentrically to the louver or louvers, driving the window open or closed. Advantageously, a secondary lock mechanism is operatively disposed in the window frame adjacent to a connecting bar disposed between adjacent louver panels and positioned in spaced relation to the foregoing operating mechanism. The secondary locking mechanism is adapted to engage the connecting bar when the louvers are in a closed position so as to prevent pivotal outward movement of the louvers.

According to an inventive aspect, the linkage includes two toggle joints, namely at opposite ends of the secondary lever. The secondary lever, like the actuating lever, is rotatably mounted to the window frame. The first toggle joint is located between the first and second mounting locations (the fixed axes of the actuating lever and the secondary lever, respectively), while the second toggle joint is located between the second mounting location and the louvers of the jalousie window.

According to another aspect of the invention, the actuating lever includes an actuating portion. The actuating and connecting portions generally extend in opposite directions from their pivot coupling at the first mounting location. The actuating portion is longer than the connecting portion. In this way, force applied to the actuating portion is magnified at the connecting end, which gives the user a mechanical advantage and facilitates operation of the window.

According to another inventive aspect, the jalousie window includes first and second brakes, one applying friction to the actuating lever and the other applying friction to the secondary lever of the linkage. The brakes help maintain the linkage stationary at the angular orientation occupied when the user releases any actuating force on the actuating lever. The stationary linkage, in turn, keeps the louvers at a desired orientation at any angle between and including the extreme open and closed positions. The brakes preferably comprise nylon brake discs or shoes, interposed between the window frame and either or both of the actuating lever and the secondary lever, at the first and second mounting locations. The brake shoes may be provided with a way of adjusting the frictional force applied by the brakes to either the actuating lever or the secondary lever. However, due to the secondary capability of locking the louvers in the closed position, it is less necessary to set the frictional force high.

BRIEF DESCRIPTION OF THE DRAWINGS

There are shown in the drawings an exemplary embodiment of the invention as presently preferred. It should be understood that the invention is not limited to the particular embodiments disclosed, and is capable of variation within the scope of the appended claims. In the drawings.

DETAILED DESCRIPTION OF THE PREFERRED EMBODIMENT

Figure 1:
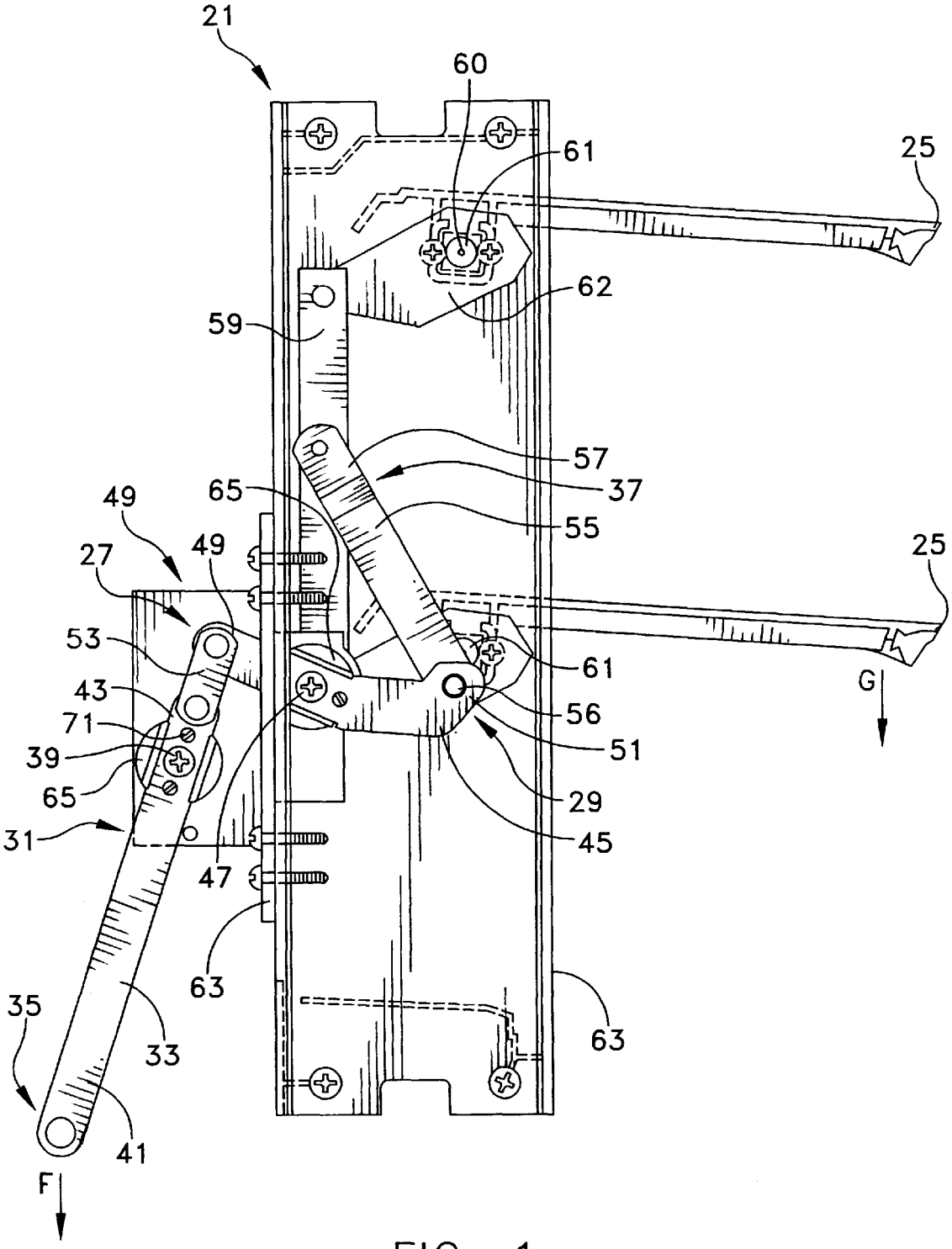
FIG. 1 is a side elevational view of a jalousie window operator according to the present invention, with the window shown in the fully opened position.

FIGS. 1–5 show an operating mechanism or operator 23 for opening, shutting, adjusting or otherwise actuating or operating a plurality of louvers 25 of a jalousie window 21. Operator 23 includes two toggle joints 27, 29, each of which toggles between the positions shown in FIG. 1 when the window is fully opened and the positions shown in FIG. 2 when the window is fully closed.

Toggle joints 27, 29 are part of a linkage 31 which also includes an actuating lever 33. The lever is shown as a simple metal bar, but can include a knob or similar handle grip for manual manipulation. Alternatively, the lever can be coupled to a powered mechanism such as a motor or solenoid (not shown). To operate jalousie window 21, actuating lever 33 is moved upwardly or downwardly through a predetermined arc between the two limit positions shown in FIGS. 1 and 2. Actuating lever 33 is mounted to rotate around a pivot point 39 that is fixed relative to the window frame, and imparts a mechanical advantage when operating window 21. Toggle joints 27, 29 are disposed along linkage 31 so that, as more fully described below, when window 21 is closed as in FIG. 2, force applied to louvers 25 from the outside (i.e., attempts to pivot the louvers around their pivot axes 60) generally cannot force window 21 open; and, when window 21 is in the fully opened position shown in FIG. 1, force applied to louvers 25 from outside does not cause inadvertent closure of window 21. The mechanism is mechanically stable and latched in these two positions, or can be set at intermediate points where the position is held by friction.

Linkage 31 of operator 23 extends from an actuator end 35 at one end of linkage 31 to a window end 37 at the opposite end of linkage 31. The linkage 31 shown in FIGS. 1 and 2 has four members or links, each pivotally connected to the adjacent links at their ends, and two being attached at intermediate pivot points 51, 57 that are fixed relative to the window frame. The terms "connected" and "interconnected," when used in this disclosure to describe the relationship between two or more structures, means that such structures are secured or attached to each other either directly or indirectly through intervening structures, and includes pivotal connections. The term "operatively connected" means that the foregoing direct or indirect connection between the structures allows such structures to operate as intended by virtue of such connection.

Actuating lever 33 is connected to window 21 at a mounting location 39. Actuating lever 33 rotates about mounting location 39 between the limit positions shown in FIGS. 1 and 2, respectively. Actuating lever 33 includes an actuating portion 41 extending in one direction from mounting location 39, and a connecting portion 43 extending in another direction, preferably opposite from mounting location 39 as shown. Because actuating portion 41 is longer than connecting portion 43, force applied to actuating portion 41, such as is indicated by arrow F, is magnified by leverage at connecting portion 43, producing a mechanical advantage in force together with a reduction in linear displacement. The mechanical advantage facilitates operation of operator 23 and window 21.

Linkage 31 also includes a secondary lever 45 at a medial location between the ends of linkage 31. Like actuating lever 33, secondary lever 45 is rotatably mounted, but at a second mounting location 47 spaced a predetermined distance from first mounting location 39 and likewise fixed relative to the window frame. Like actuating lever 33, secondary lever 45 is in the form of a substantially elongated member. A portion 49 of secondary lever 45 extends from mounting location 47 in a first direction, and a second portion 51 extends substantially in the opposite direction from mounting location 47. Secondary lever 45, in this embodiment, is connected to actuating lever 33 by means of a relatively short connecting link 53, which connects the actuating and secondary levers while accommodating the fact that the ends of the two connected levers rotate around spaced pivot axes. In particular, connecting link 53 has one end rotatably secured to portion 49 of secondary lever 45, while the other end of connecting link 53 is rotatably secured to connecting portion 43 of actuating lever 33. In this way, connecting link 53 extends between opposing end portions of actuating and secondary levers 33, 45.

A window link 55 is rotatably connected to portion 51 of secondary lever 45 at a suitably selected pivot point 56 thereon. In this embodiment, window link 55 has a pair of opposite end portions 52, 57. End portion 52 is located adjacent to secondary lever 45 and includes pivot point 56 therein. Window link 55 extends from secondary lever 45 to terminate at the opposite end portion 57, and end portion 57 is rotatably connected to a first window bar 59.

First window bar 59, in turn, is operatively connected to louvers 25 by any suitable means known to the art. Preferably, louvers 25 are connected to window bar 59 by means of a torque bar link 62. Each torque bar link 62 has one end pivotally connected to window bar 59 and its other end non-rotatably attached to louver torque bar 62. Thus torque bar link 62 rotates together with the louver around the louver pivot axis 60. A suitable specific mechanical connection between the torque bar links and the louvers is disclosed in U.S. Pat. No. 4,449,121—Sosa, which is hereby incorporated. Whereas the pivot connection between the window bar 59 and the torque bar link is spaced from the louver rotation axis, the pivotal connection between window bar 59 and torque bar link 62 is eccentric to the louver pivot axis.

Figure 6:
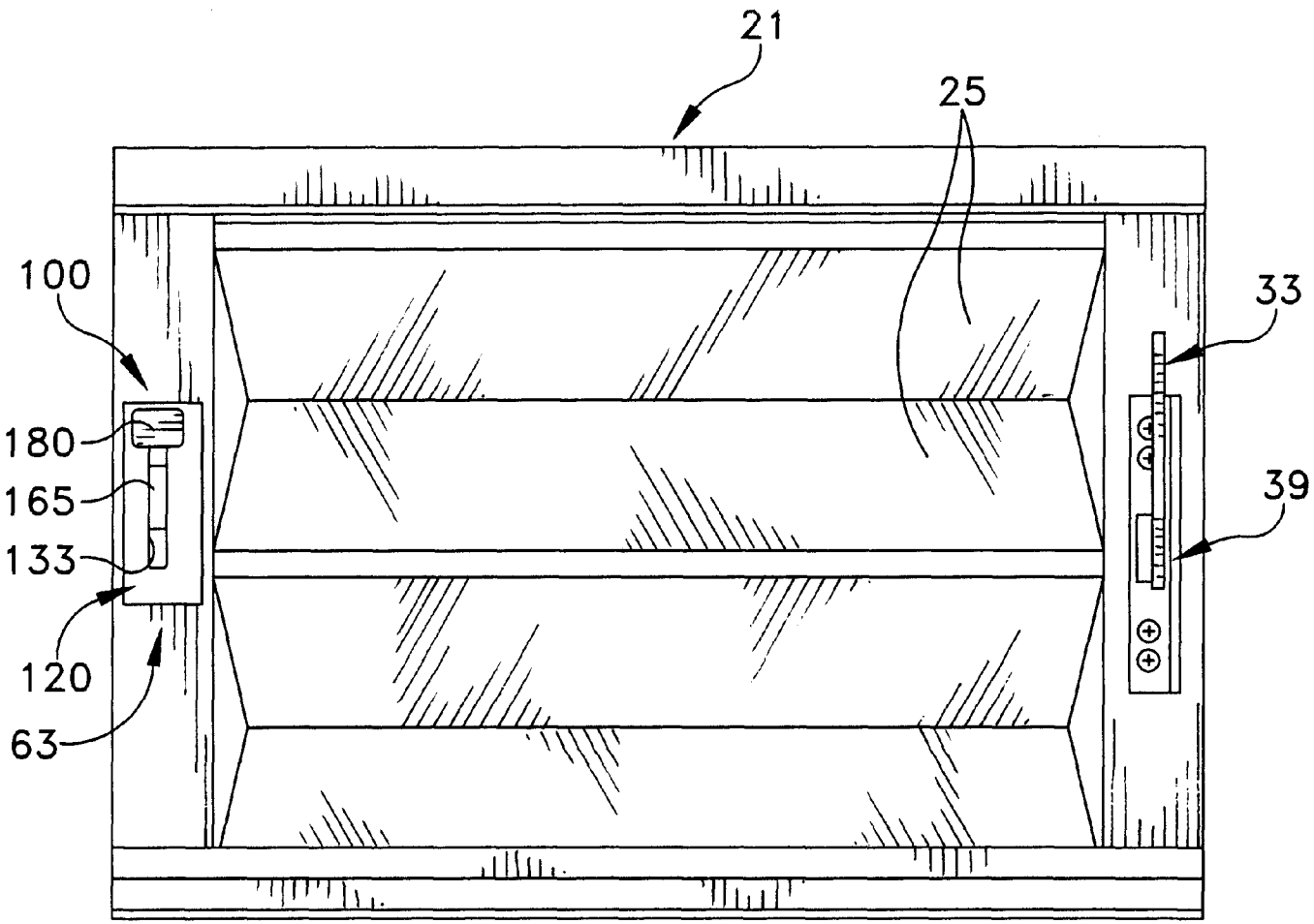
FIG. 6 is a front elevational view of a louvered window formed in accordance with a further embodiment of the invention.

Louvers 25 are connected to respective louver torque bars 60 in a cantilevered fashion in that louver pivot axis 60 is nearer to the top of the louver, causing most of the weight of the louvers to exert a torque when the window is open, urging the louvers to close. In this embodiment, louvers 25 are connected to a first window bar 59 at two spaced locations along the length of window bar 59, but the mechanism is extendible to additional louvers by repeating the mechanism shown. A second window bar 59A is connected to louvers 25 at two spaced locations that correspond to the connection points for first window bar 59, but are disposed in spaced parallel-relation thereto (see FIG. 6). Window bars 59, 59A undergo a vertical translational movement in response to rotation of actuating lever 33, and also are displaced laterally in the manner of a parallelogram linkage. Each of the louvers 25 and their corresponding torque bars 60 are connected to window frame 63 so that, in response to rotation of actuating lever 33, the louvers 25 rotate about respective axes 61, which are oriented horizontally in FIGS. 1 and 2. Vertical or otherwise oriented louver axes are also possible.

The interconnections between the elements of linkage 31 are accomplished by suitable fasteners which, where required, provide for rotation of the members relative to each other. Such fasteners are preferably shoulder rivets, shoulder screws or the like.

First toggle joint 27 is located between fixed pivot mounting locations 39, 47. In this embodiment, toggle joint 27 comprises opposing end portions 43, 49 of levers 33, 45, respectively, as well as connecting link 53 which extends between such opposing end portions 43, 49. First toggle joint 27 is thus a compound joint in this embodiment, meaning it has points of toggling or rotation at two locations at the opposite ends of connecting link 53 rather than one location.

Referring now particularly to FIG. 1, when the window is fully opened, toggle joint 27 assumes the position in which connecting link 53 is substantially aligned with connecting portion 43 of actuating lever 33. It will be appreciated that when toggle joint 27 is in the position shown in FIG. 1, toggle joint 27 is disposed relative to louvers 25 so as to resist the downward force caused by the weight of louvers 25 when in the opened position. Such downward force is indicated by the arrow G and located at the outer side of window 21. Toggle joint 27 thus assists in "locking" window 21 in its fully opened position shown in FIG. 1.

Figure 2:
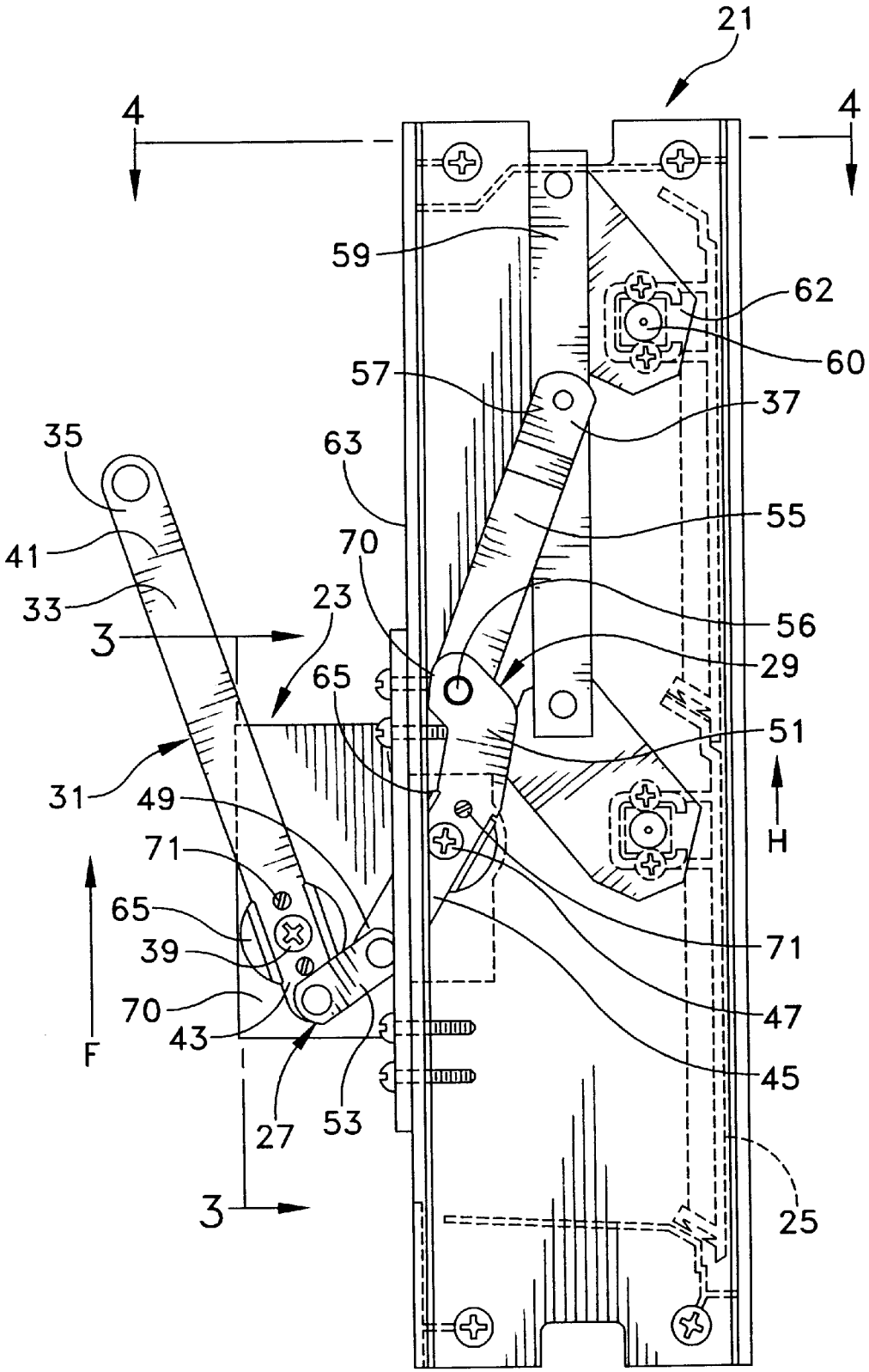
FIG. 2 is a side elevational view of the embodiment of FIG. 1, with the jalousie window in the fully closed position.

When window operator 23 is actuated to move louvers 25 from their fully opened position shown in FIG. 1 to their fully closed position shown in FIG. 2, toggle joint 27 likewise moves from its position shown in FIG. 1 to its position shown in FIG. 2. When the window is fully closed as shown in FIG. 2, connecting link 53 is substantially aligned with end portion 49 of secondary lever 45, rather than portion 43 of actuating lever 33.

Figure 3:
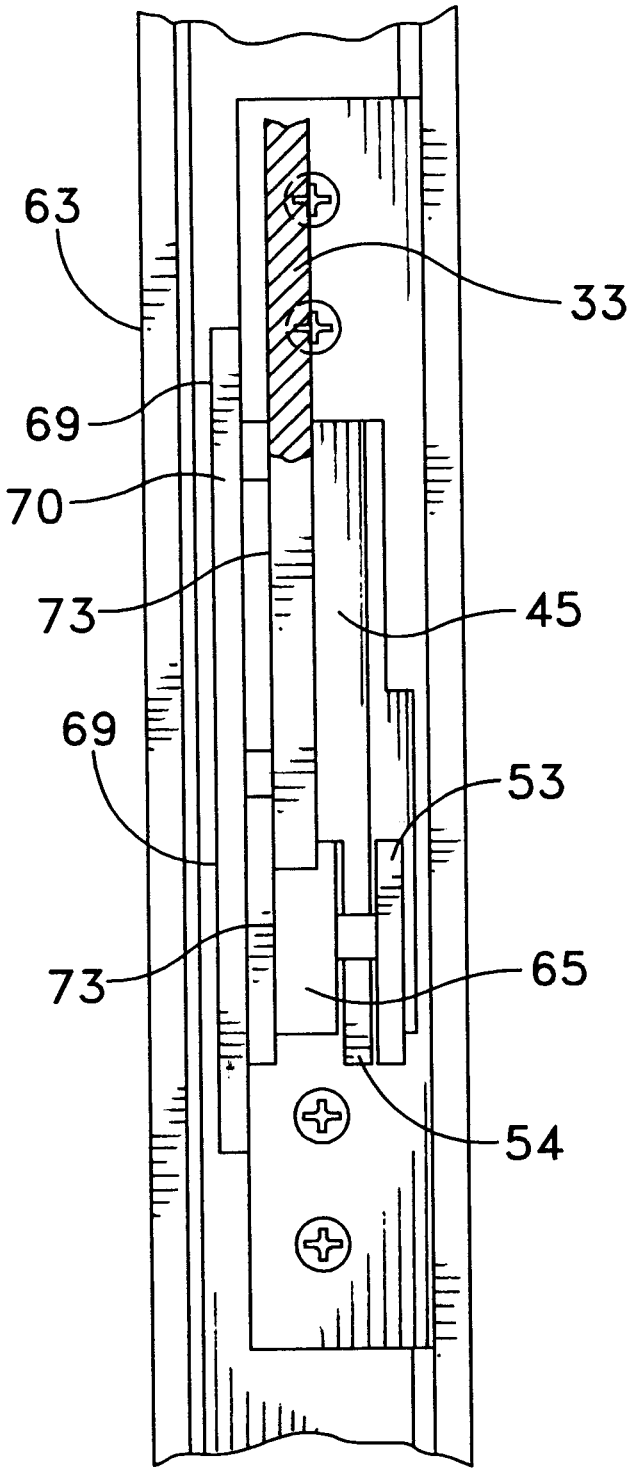
FIG. 3 is front, sectional view taken along line 3—3 of the embodiment shown in FIG. 2.
Figure 4:
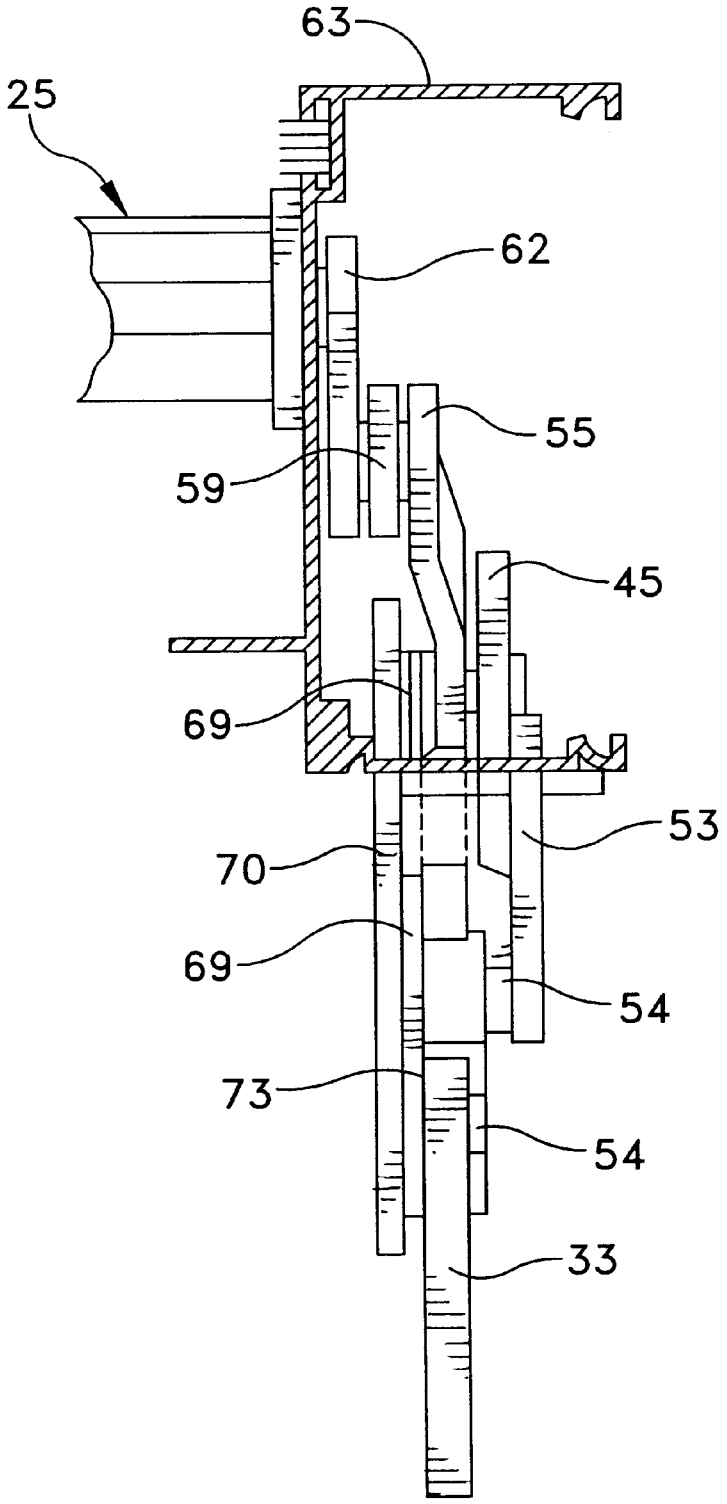
FIG. 4 is a top, sectional view of the embodiment of FIGS. 1 and 2 taken along line 4—4.
Figure 5:
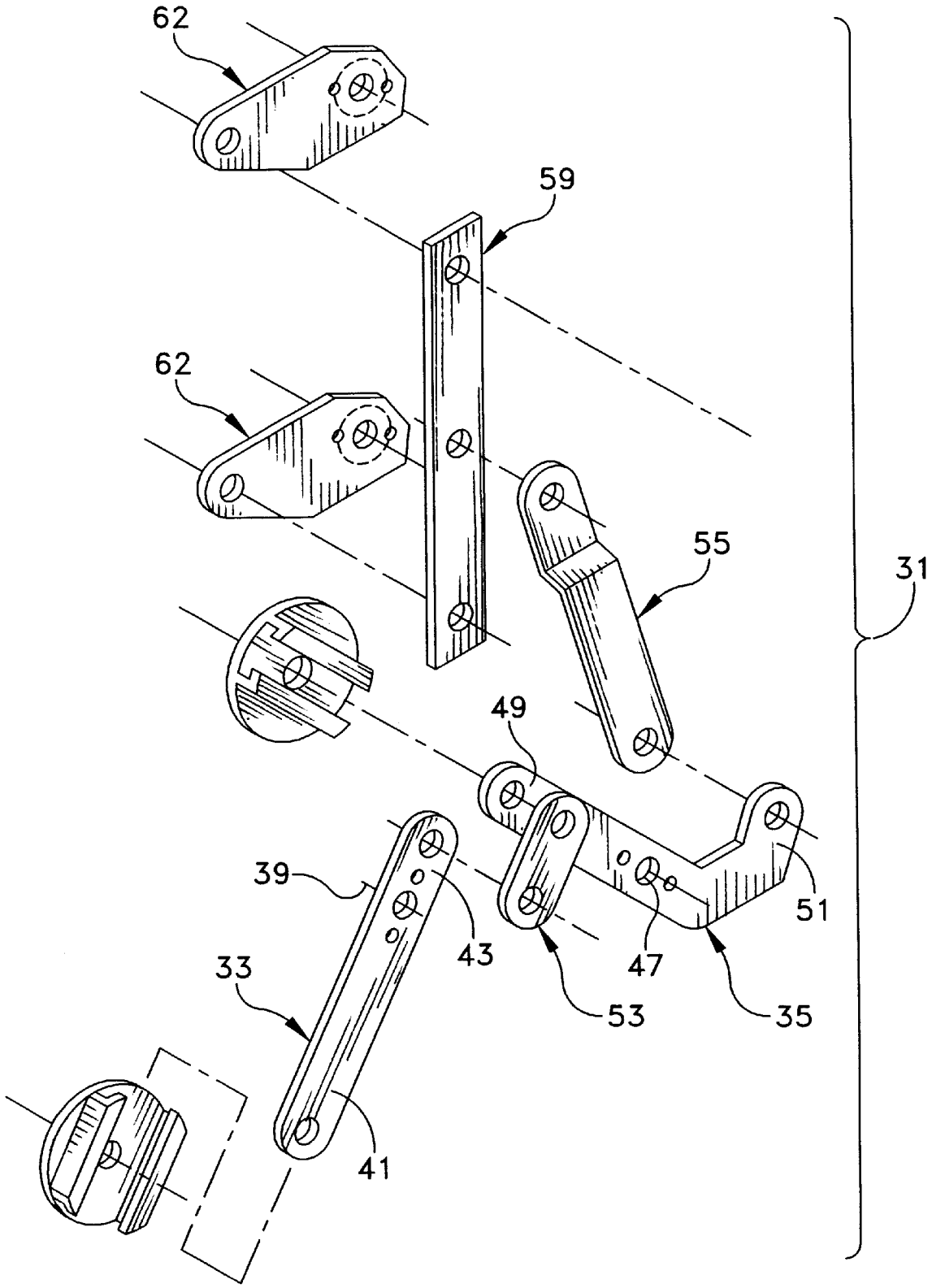
FIG. 5 is an exploded, perspective view of certain operational components of the jalousie window of FIGS. 1–4.

The lengths of connecting link 53 and portions 43, 49 are selected so that rotation of actuating lever 33 through its predetermined arc causes movement of toggle joint 27 and rotation of secondary lever 45 about mounting location 47. As best seen in FIGS. 3 and 4, linkage 31 includes suitable spacers 56 interposed laterally between connecting link 53 and end portions 43, 49. Spacers 56 place connecting link 53 in a different plane of rotation from opposing end portions 43, 49, so that these elements do not interfere by coming into contact with each other.

Toggle joint 29 is located between mounting location 47 and louvers 25. In this particular embodiment, toggle joint 29 comprises window link 55 and portion 51 of secondary lever 45. Window link 55 and portion 51 rotate relative to each other at the pivot point 56. The two components of toggle joint 29, that is, elements 55, 51, toggle from one side of window bar 59 to the other upon rotation of actuating lever 33 between its positions shown in FIGS. 1 and 2, respectively. Toggle joint 29 is of a suitable length so that it reaches one of its limit positions when louvers 25 are closed as shown in FIG. 2.

In the limit position shown in FIG. 2, toggle joint 29 is positioned relative to window bar 59 so as to resist opening force, such as shown by arrow H, applied to louvers 25 from the outer side of window 21. In such position, the pivotally connected ends of window link 55 and portion 51 generally abut, and are in contact with the window frame 63 of window 21. In particular, portion 51 has been formed with a flange 70 which is oriented and shaped to directly contact frame 63 in the limit position shown in FIG. 2. It is believed such contact with frame 63 prevents the opening forces exerted against louvers 25 in the direction of arrow H from causing window bar 59 to move in the downward direction (when window 21 is oriented as shown in FIG. 2). In addition as discussed above, links 45 and 53 are in line in this position, which further isolates forces produced, for example, by attempting to pry open the louvers, preventing such forces from generating the necessary rotational force to open the window. Toggle joint 29 thus assists in locking window 21 when louvers 25 are in the fully closed position shown in FIG. 2. Window 21 can be "unlocked" from its position shown in FIG. 2 generally only by rotating actuating lever 33 downwardly.

Figure 7:
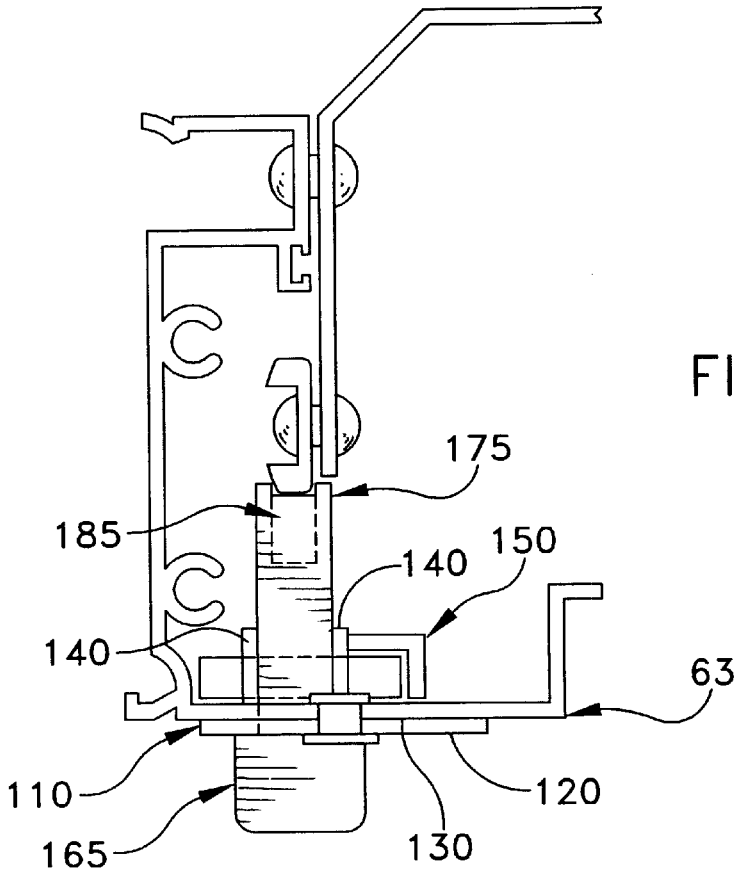
FIG. 7 is a top view of a secondary locking mechanism assembled to the frame of the louvered window shown in FIG. 6.
Figure 8C:
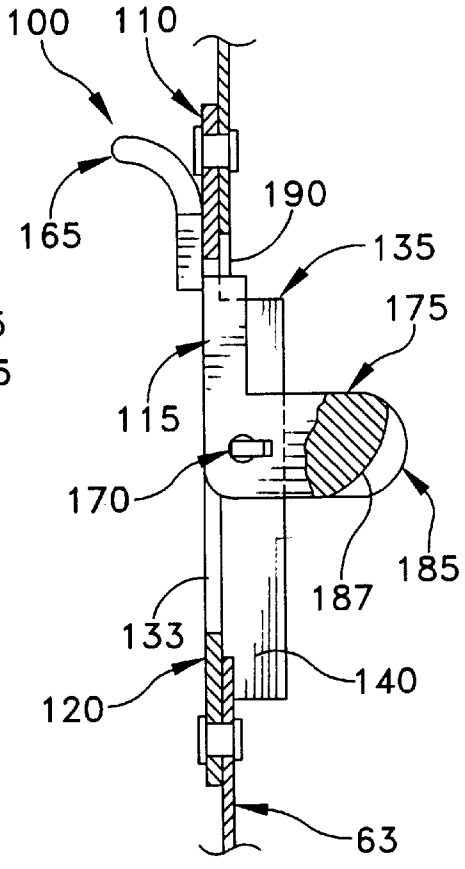
FIGS. 8A–8C show a secondary locking mechanism in accordance with the invention in successive stages of assembly to the louvered window frame shown in FIG. 6.
Figure 8B:
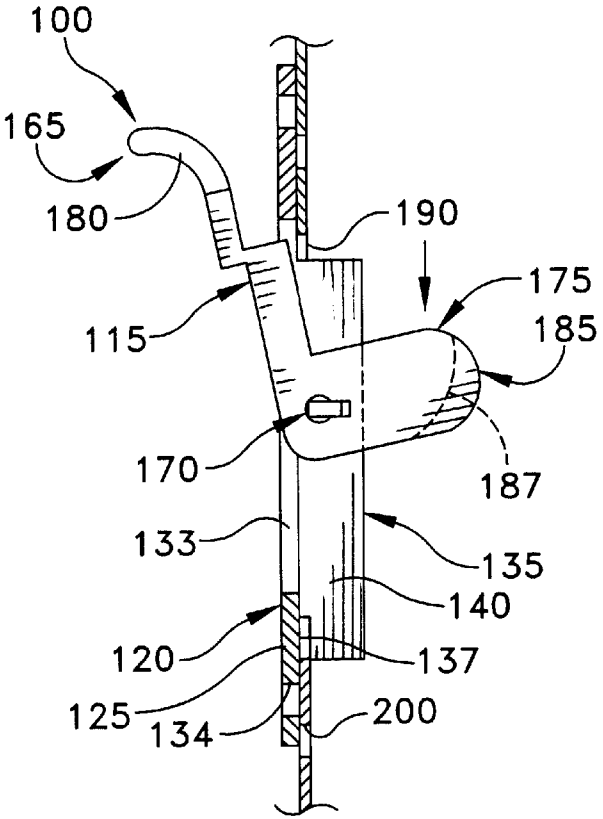
Figure 8A:
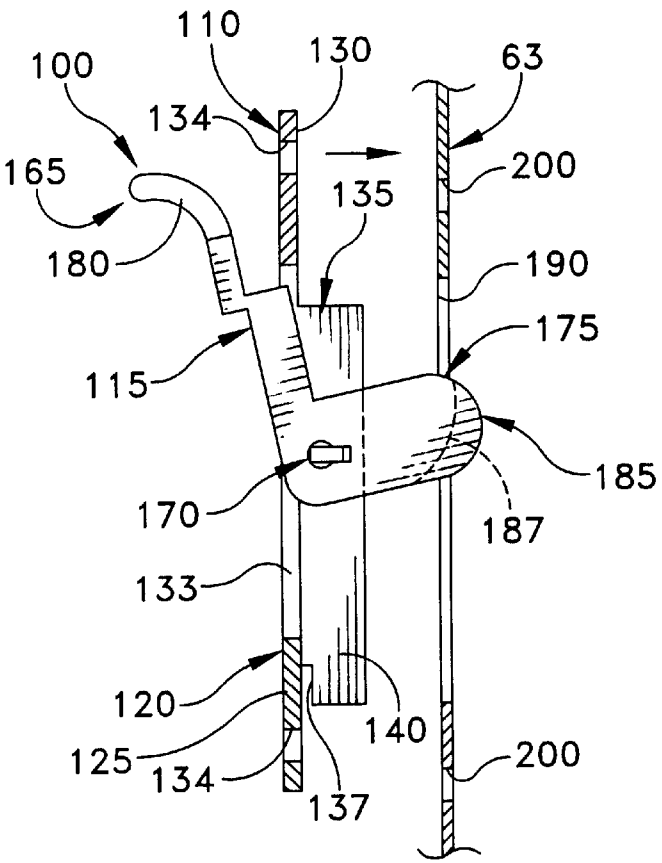

In a further embodiment of the present invention shown in FIGS. 6–12, a secondary lock mechanism 100 (FIG. 6) is operatively disposed in frame 63 of window 21, to more positively prevent movement of louvers 25 in response to negative (outward) pressure due, e.g., to stormy weather conditions or prying. Referring to FIGS. 7 and 8, secondary lock 100 comprises a housing 110 and a lever lock 115. Housing 110 includes a face plate 120 having a front surface 125, a rear surface 130, a vertically oriented opening 133, and mounting holes 134. A pivot yoke 135 comprises a pair of spaced brackets 140 that project outwardly from rear surface 130 on either side of opening 133. Each pivot bracket 140 comprises a pivot hole disposed midway along its length, in coaxial confronting relation to one another, and a frame slot 137 (FIGS. 8A and 8B) disposed between rear surface 130 of face plate 120 and the lower inner edge portion of each pivot bracket 140. Pivot bracket 140 further includes an assembly pin stop 150 (FIG. 7). Assembly pin stop 150 comprises an "L"-shape and projects outwardly from a side surface of one pivot bracket 140. "L"-shaped pin stop 150 comprises two side walls in mutually perpendicular relationship. Pin stop 150 projects outwardly from the side surface of bracket 140 by one side wall so that the other side wall projects back toward rear surface 130 of face plate 120.

Referring to FIGS. 7 and 8A–C, lever lock 115 comprises an actuator arm 165, pivot pin 170 and a cam 175. Actuator arm 165 comprises a first end having a grip 180 and a second end including pivot pin 170 and cam 175. Grip 180 is radiused to curve away from face plate 120 so as to provide a gripping surface for an operator's fingers. Pivot pin 170 is positioned in a through-hole located transversely through actuator arm 165, and adjacent to a rear portion of cam 175 such that one portion of pivot pin 170 projects outwardly from each side surface of actuator arm 165. Cam 175 projects outwardly from actuator arm 165 and in a direction opposite to that of grip 180. Cam 175 comprises a longitudinally extending grooved camming edge 185 that is adapted for sliding engagement with second window bar 59A, as discussed in further detail below. Grooved camming edge 185 is formed to have a longitudinally varying depth. In this way, grooved camming edge 185 defines a curved camming surface 187 that follows the curve of, e.g., a cycloid, a parabola, a hyperbola, etc.

Secondary lock 100 permits louvered windows 21 to be locked in their closed position, on the side that is normally free, by exertion of mechanical pressure on second window bar 59A. Referring to FIGS. 8A, 8B and 8C, secondary lock 100 is assembled to window frame 63 in the following manner. Lever lock 115 is first assembled to housing 110 by orienting lever lock 115 so that cam 175 is disposed in aligned confronting relationship with opening 133 in face plate 120. In this position, grip 180 extends in a direction away from face plate 120. Lever lock 115 is then moved toward housing 110 so that cam 175 enters vertical opening 133. Lever lock 115 continues to pass through face plate 120 until the through-hole in actuator arm 165 is coaxially aligned with the pivot holes defined in pivot brackets 140. Pivot pin 170 is then inserted through the pivot holes until it engages pin stop 150. In this arrangement, lever lock 115 is pivotally fixed to housing 110, with grip 180 disposed adjacent to front surface 125 and cam 175 disposed adjacent to rear surface 130 (FIG. 8A).

Figure 9:
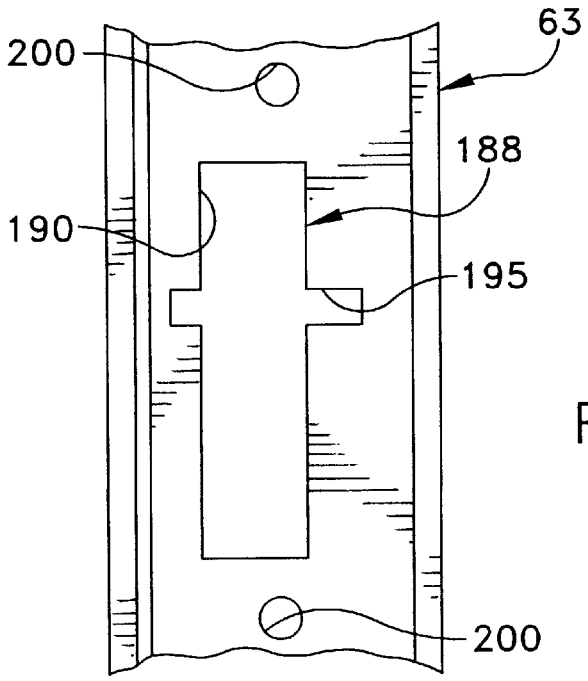
FIG. 9 is a broken-away, elevational view of a portion of the louvered window frame shown in FIG. 6 that is adapted to accept a secondary locking mechanism.

Next, secondary lock 100 is assembled to frame 63. As shown in FIG. 9, frame 63 comprises a cruciform opening 188 having a vertically oriented portion 190 and a horizontally oriented portion 195. Holes 200 are disposed, one each, above and below vertically oriented portion 190 of opening 188. Holes 200 receive fastening means such as rivets, screws, or the like. To begin the assembly process, secondary lock 100 is oriented so that rear surface 130 of face plate 120 is in confronting aligned relationship with opening 188 in the outwardly facing surface of window frame 63 (FIG. 8A). Secondary lock 100 is then moved toward window frame 63 so that cam 175 and pivot brackets 140 enter vertically oriented portion 190 of opening 188, with pivot pin 170 passing through horizontally oriented portion 195, and cam 175 and pivot brackets 140 passing through vertically oriented portion 190. Once in this position (FIG. 8B)

housing 110 is slid downwardly such that the edge of frame 63 slides into frame slots 137 at the lower inner end portion of pivot brackets 140, so that holes 134, 200 in face plate 120 and window frame 63 are coaxially aligned. In this position, secondary lock 100 is fastened to window frame 63 by placement of fastening means (e.g., rivets, screws, or the like) through holes 134, 200 (FIG. 8C). It will be appreciated that the relative distance (indicated at "D" in FIG. 10) between cam 175 and window bar 59A may vary depending upon the particular style of window 21.

Figure 10:
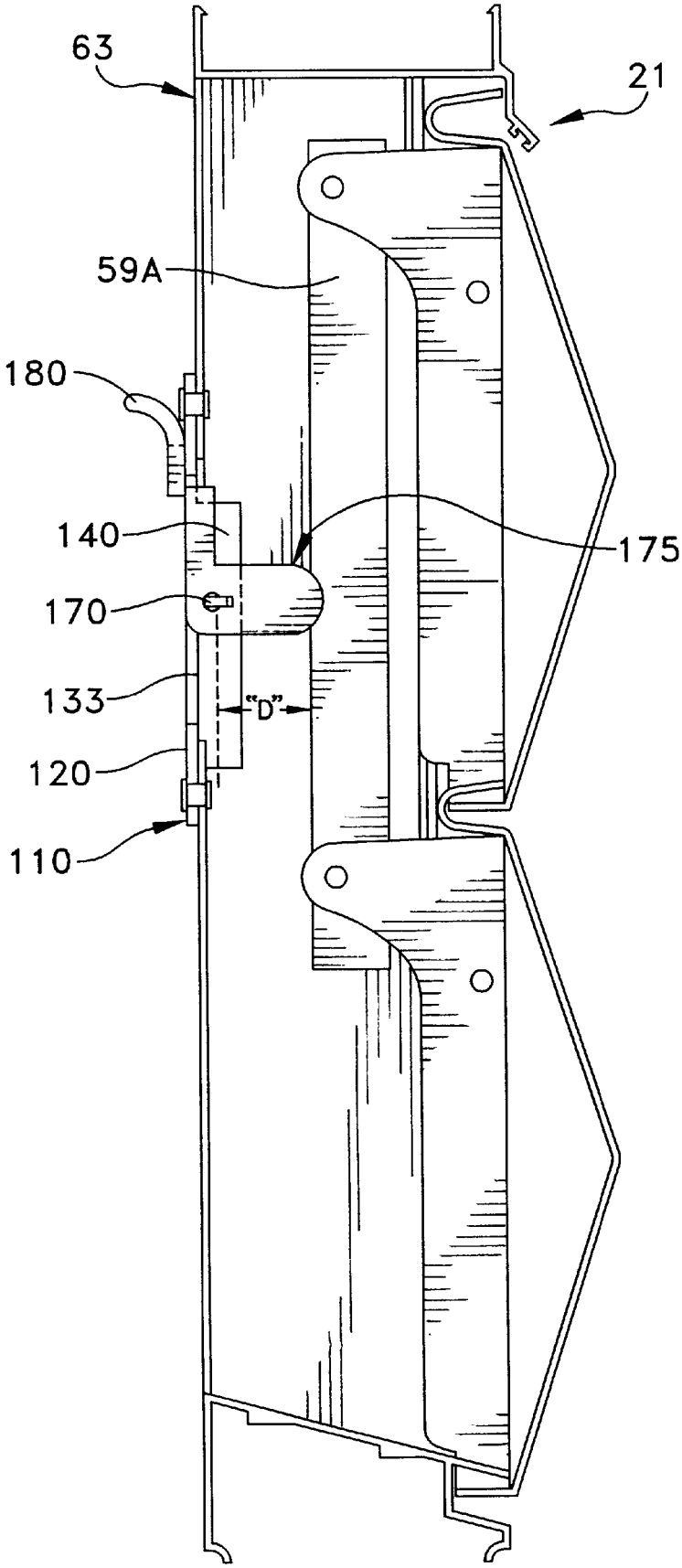
FIG. 10 is a side elevational view of the louvered window shown in FIG. 6, in a closed position.
Figure 11:
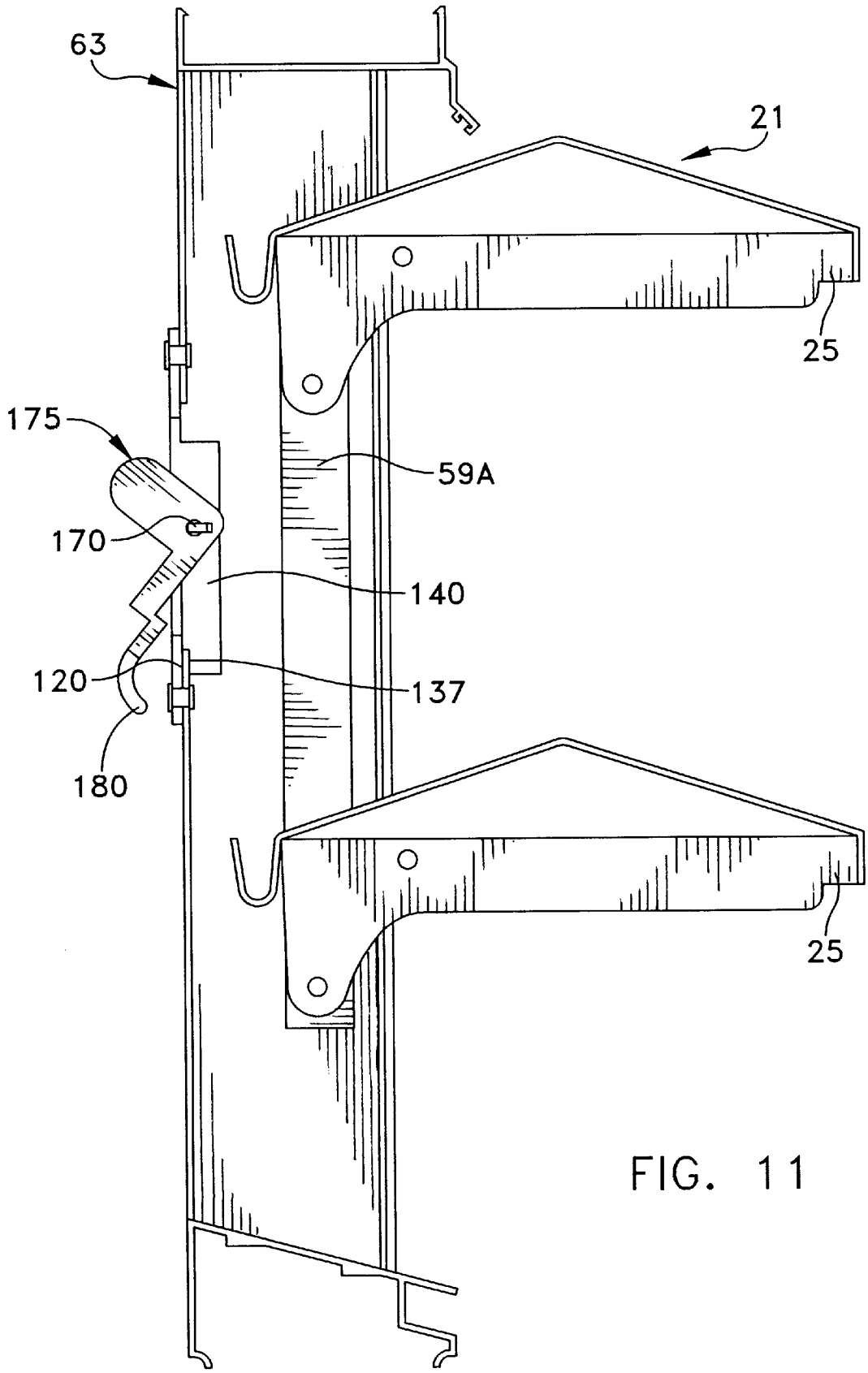
FIG. 11 is a side elevational view of the louvered window shown in FIGS. 6 and 10, in an open position.

To activate secondary lock 100, window 21 is closed as discussed above, with secondary lock 100 rotated about pivot pin 170, as shown in FIGS. 10 and 11. With window 21 closed, lever lock 115 is rotated about pivot pin 170, and toward frame 63, such that camming edge 185 of cam 175 rotates into engagement with second window bar 59A. As this occurs, the edge of second window bar 59A enters grooved camming edge 185 and begins to engage cam 175. As a result, as actuator arm 165 is moved toward window frame 63, second window bar 59A moves into tight mechanical engagement with grooved edge 185. Inasmuch as window bars 59, 59A undergo both a vertical translation movement and a lateral displacement in the manner of a parallelogram linkage as louvers 25 are opened, the lateral displacement will be stopped due to the engagement of cam 175 with second window bar 59A.

To release secondary lock 100, an operator merely needs to pull down on actuator arm 165, thereby pivoting cam 175 about pivot pin 170. In turn, grooved camming edge 185 is moved away from engagement with second window bar 59A, allowing for the lateral displacement of second window bar 59A during the opening operation of louvers 25, as discussed above.

Jalousie window operator 23 is further provided with one or more brakes 65. Brakes 65 are preferably selected and adjusted so as to maintain linkage 31 at any desired position in its range when actuating force is not being applied to actuating lever 33. In this way, brakes 65 also keep louvers 25 at a predetermined angular orientation or position, ranging from fully opened to fully closed.

Brakes 65 are operatively connected to actuating lever 33 and secondary lever 45, respectively, meaning that brakes 65 are located so as to apply frictional force to corresponding levers 33, 45. Brakes 65 preferably comprise nylon brake discs or shoes, which are shaped and sized so that they can be interposed between window frame 63 and the actuating lever 33 and secondary lever 45, respectively. Brakes 65 have surfaces 69 in frictional contact with portions of window frame 63, as best seen in FIGS. 3 and 4.

Brakes 65 are centered about respective mounting locations 39, 47 and can be clipped to or otherwise engaged with corresponding levers 33, 49, so as to rotate along with them to produce frictional contact with mounting flanges 70 that are fixed to the window frame and define the fixed pivot axes. More particularly, frictional forces are generated by contact between brake surfaces 69 and the flanges 70 affixed to frame 63, which are attached to the window frame by screws.

Brakes 65 include means for adjusting the frictional force between brakes 65 and frame 63, such means comprising one or more brake adjusting screws 71. Brake adjusting screws 71 are threaded into and through levers 33, 49 and are of sufficient length so that the bottom ends of screws 71 contact brake surfaces 73 opposite brake surfaces 69. As brake adjusting screws 71 are threadably advanced through corresponding levers 33, 45, screws 71 exert increased force against corresponding brake surfaces 73. When the force exerted against brake surfaces 73 increases, opposite brake surfaces 69 are urged against frame 63 with a correspondingly increased force. In this way, frictional force between brake surfaces 69 and frame 63 is increased by virtue of the advancement of brake adjusting screws 71 toward and more tightly against brakes 65. Likewise, if adjusting screws 71 are backed out of or threadably retreated from corresponding levers 33, 44, then relatively less force is applied to brake surfaces 73, 69, and, correspondingly, less frictional force is present between brake surfaces 69 and window frame 63.

Operation of jalousie window 21 and its associated operator 23 is readily apparent from the above description. Actuating lever 33 is caused to rotate by application of suitable force, either manually or by means of a pole operator or other appropriate linkage and/or source of mechanical power. Rotation of actuating lever 33 causes toggle joints 27, 29 of linkage 31 to move between their respective toggle limited positions shown in FIGS. 1 and 2. Toggle joint 27 assists in maintaining window 21 in a fully opened position by virtue of alignment of connecting link 53 with lever 33. Toggle joint 29, for its part, assists in maintaining window 21 in a closed position by virtue of being in a limit position to one side of window bar 59, as well as by virtue of its abutment against window frame 63. The load of cantilevered louvers 25 in their various intermediate, open positions can be counteracted by means of brakes 65, so that louvers 25 remain in a relatively fixed position when minimal or no force is being exerted on actuating lever 33.

Jalousie window 21 and its associated operator 23, according to the present invention, can be applied in any of a variety of residential, commercial, and industrial settings. The present invention is equally well-suited for louvers made out of any of a variety of materials, ranging from metal or other opaque material to glass, plexiglas or other transparent materials, in any of a variety of thicknesses.

The invention has the advantage of being readily adaptable to different weights of louvers in that brakes 65 can be adjusted depending on the combined louver weight, and actuating lever 33 can be selected to supply sufficient mechanical advantage to allow the window to be readily and easily operated.

In addition to the advantages apparent from the foregoing description, the jalousie window and operator according to the invention is straightforward and easy for the user to operate, while at the same time satisfying ventilation, security, access, or other requirements associated with such window.

The operator 23 affords a mechanical advantage such that particularly robust or heavy jalousie windows can be designed and yet operated with an acceptable amount of force and without requiring excessive exertion.

The invention has the further advantage of allowing the jalousie window to be locked in its fully opened or fully closed position, but also to be adjustable so as to have the louvers remain in any of a variety of predetermined angular orientations.

Having disclosed the invention in connection with the foregoing embodiment, additional variations within the scope of the invention will now be apparent to persons skilled in the art. The invention is not intended to be limited to the embodiments and variations specifically mentioned, and accordingly, reference should be made to the appended claims, rather than the foregoing discussion of preferred examples, in order to assess the scope of the invention in which exclusive rights are claimed.

What is claimed is:

1. An operator and lock for a jalousie window having at least two louvered windows and a window frame, said operator and lock comprising:

a linkage for operating said window, said linkage having an actuator end and a window end opposite said actuator end wherein said window end comprises a connecting bar linking adjacent window louvers; and at least one toggle joint in said linkage;

said linkage further comprising an actuating lever at said actuator end, said actuating lever being secured to said window at a first mounting location and rotatable relative to said mounting location through a predetermined arc to actuate said toggle joint and open and close said window; and, means for engaging said connecting bar so as to disable said linkage including a housing comprising a face plate having a front surface, a rear surface, a vertically oriented opening, and a pair of spaced-apart brackets that project outwardly from said rear surface on either side of said vertically oriented opening; and a lever pivotably supported by said housing.

2. The operator and lock according to claim 1 wherein each bracket comprises a pivot hole defined along its length wherein each of said holes are arranged in coaxial confronting relation to one another and further defines a slot disposed between said rear surface of said face plate and a lower inner edge portion of each of said brackets.

3. The operator and lock according to claim 1 wherein each bracket includes a pivot pin stop projecting outwardly from a side surface, said pivot pin stop comprising two side walls in mutually perpendicular relation to one another so that said pivot pin stop projects outwardly from said side surface of said bracket by one of said side walls with the other of said side walls projecting back toward said rear surface of said face plate.

4. The operator and lock according to claim 1 wherein said lever comprises an actuator arm having a first end defining a grip and a second end including a trasverse through-hole adapted to receive a pivot pin.

5. The operator and lock according to claim 4 wherein said grip is radiused to curve away from s aid window frame so as to provide a gripping surface for an operator.

6. The operator and lock according to claim 5 wherein said grooved camming edge is formed to have a longitudinally varying depth.

7. The operator and lock according to claim 4 wherein said second end of said lever further includes a camming edge.

8. The operator and lock according to claim 7 wherein said pivot pin is positioned in adjacent to a rear portion of said camming edge such that one portion of said pivot pin projects outwardly from each side surface of said actuator arm.

9. The operator and lock according to claim 8 wherein said pivot pin is positioned in adjacent to a rear portion of said camming edge such that one portion of said pivot pin projects outwardly from each side surface of said actuator arm.

10. The operator and lock according to claim 8 wherein said camming edge projects outwardly from said second end of said actuator arm in a direction opposite to that of said grip.

11. The operator and lock according to claim 8 wherein said camming edge comprises a longitudinally extending groove that is adapted for sliding engagement with said connecting bar.

12. The operator and lock according to claim 7 wherein said camming edge projects outwardly from said second end of said actuator arm in a direction apposite to that of said grip.

13. The operator and lock according to claim 7 wherein said camming edge comprises a longitudinally extending groove that is adapted for sliding engagement with said connecting bar.

14. A jalousie window comprising:

an actuating lever rotatably mounted to a first axis;

a secondary lever rotatably mounted to a second axis;

a connecting link extending between the levers, the link being rotatably secured to the levers at first and second locations which are radially spaced from the first and second axes;

a window link having first and second, opposite, end portions, the first end portion being rotatably connected to the secondary lever;

a window bar;

a plurality of louvers, the louvers being operatively connected at spaced locations on the window bar, the second end portion rotatably connected to the window bar, the window bar being mounted to the window so as to be capable of translational motion relative to the louvers whereby rotation of the actuating lever rotates the secondary lever and causes translation of the window bar to operate the jalousie window; and, means for engaging said window bar so a to selectively prevent operation of said louvers including a housing comprising a face plate having a front surface, a rear surface, a vertically oriented opening and a pair of spaced-apart brackets that project outwardly from said rear surface or either side of said vertically oriented opening; and a lever pivotably supported by said housing.

15. The operator and lock according to claim 14 wherein each bracket comprises a pivot hole defined along its length wherein each of said holes are arranged in coaxial confronting relation to one another and further defines a slot disposed between said rear surface of said face plate and a lower inner edge portion of each of said brackets.

16. The operator and lock according to claim 14 wherein each bracket includes a pivot pin stop projecting outwardly from a side surface, said pivot pin stop comprising two side walls disposed in mutually perpendicular relation to one another so that said pivot pin stop projects outwardly from said side surface of said bracket by one of said side walls with the other of said side walls projecting back toward said rear surface of said face plate.

17. The operator and lock according to claim 14 wherein said lever comprises an actuator arm having a first end defining a grip and a second end including a transverse through-hole adapted to receive a pivot pin.

18. The operator and lock according to claim 17 wherein said second end of said lever further includes a camming edge.

19. The operator and lock according to claim 17 wherein said grip is radiused to curve away from said window frame so as to provide a gripping surface for an operator.

20. The operator and lock according to claim 14 wherein said grooved camming edge is formed to have a longitudinally varying depth.

* * * * *